US011021000B2

(12) United States Patent
Leuenberger et al.

(10) Patent No.: US 11,021,000 B2
(45) Date of Patent: Jun. 1, 2021

(54) SYSTEM AND METHOD FOR POSITIONING PRINTED PRODUCTS IN OPERATIVE CONNECTION WITH A DELIVERY SYSTEM

(71) Applicant: Mueller Martini Holding AG, Hergiswil (CH)

(72) Inventors: Lukas Leuenberger, Schoeftland (CH); Martin Burkart, Wohlen (CH)

(73) Assignee: Mueller Martini Holding AG, Hergiswil (CH)

( * ) Notice: Subject to any disclaimer, the term of this patent is extended or adjusted under 35 U.S.C. 154(b) by 62 days.

(21) Appl. No.: 16/451,023

(22) Filed: Jun. 25, 2019

(65) Prior Publication Data

US 2020/0001643 A1 Jan. 2, 2020

(30) Foreign Application Priority Data

Jun. 29, 2018 (CH) ..... 00822/18

(51) Int. Cl.

| | |
|---|---|
| ***B42C 1/12*** | (2006.01) |
| ***B42C 19/08*** | (2006.01) |
| ***B65H 29/16*** | (2006.01) |
| ***B65H 35/00*** | (2006.01) |
| ***B65H 37/04*** | (2006.01) |

(52) U.S. Cl.

CPC ..... *B42C 19/08* (2013.01); *B42C 1/12* (2013.01); *B65H 29/16* (2013.01); *B65H 35/0086* (2013.01); *B65H 37/04* (2013.01)

(58) Field of Classification Search

CPC ..... B42C 19/08; B42C 1/12; B42C 19/02; B65H 29/16; B65H 35/0086; B65H 37/04; B65H 45/04; B42B 5/08; B26D 1/00

See application file for complete search history.

(56) References Cited

U.S. PATENT DOCUMENTS 4,260,145 A * 4/1981 Mebus ..... B42C 19/08 198/468.2
4,384,709 A * 5/1983 McCain ..... B42C 1/12 198/644

(Continued)

FOREIGN PATENT DOCUMENTS

DE 102004011973 A1 9/2005
EP 0893295 A1 1/1999

(Continued)

*Primary Examiner* — Patrick H Mackey
(74) *Attorney, Agent, or Firm* — Leydig, Voit & Mayer, Ltd.

(57) ABSTRACT

A system, preferably a saddle stitcher, includes: a transport chain, which is roof-shaped in an upper region, along which one or more printed products is astride transportable, collected, and are optionally stapled in an intermediate stapling station; and a stop adjustable according to a format of a printed product of the printed products, the stop being arranged in a transport direction of the printed product, behind the stapling station, and along a further course of the transport chain. The stop is in operative connection with a delivery system and an ejector that operate interdependently with each other to perform a format-stabilized discharge of the printed product in accordance with a cycle; and that the format-stabilized printed product is fed to a cutting apparatus.

20 Claims, 4 Drawing Sheets

(56) References Cited

U.S. PATENT DOCUMENTS

| | | | | | |
|---|---|---|---|---|---|
| 5,678,812 | A * | 10/1997 | Hartsoe | B42C 19/08 | 270/52.16 |
| 5,967,503 | A * | 10/1999 | Newsome | B07C 5/362 | 198/380 |
| 6,095,740 | A * | 8/2000 | Hollenstein | B42B 9/04 | 270/52.26 |
| 6,994,337 | B1 * | 2/2006 | Cracknell | B26D 1/08 | 270/52.26 |
| 2002/0014510 | A1 | 2/2002 | Richter et al. | | |
| 2005/0206062 | A1 | 9/2005 | Kuechler et al. | | |
| 2005/0249575 | A1 | 11/2005 | Steinert et al. | | |
| 2014/0044501 | A1 * | 2/2014 | Arendt | B65H 5/32 | 412/6 |

FOREIGN PATENT DOCUMENTS

| | | | |
|---|---|---|---|
| EP | 1153764 | A2 | 11/2001 |
| EP | 1593526 | A2 | 11/2005 |
| GB | 2356189 | A | 5/2001 |

* cited by examiner

SYSTEM AND METHOD FOR POSITIONING PRINTED PRODUCTS IN OPERATIVE CONNECTION WITH A DELIVERY SYSTEM

CROSS-REFERENCE TO PRIOR APPLICATIONS

Priority is claimed to Swiss Patent Application No. CH 00822/18, filed on Jun. 29, 2018, the entire disclosure of which is hereby incorporated by reference herein.

FIELD

The present invention relates to a system and method for positioning printed products in operative connection with a delivery system.

BACKGROUND

In state of the art printing solutions, printed products are simply ejected into the delivery system (see list of definitions below) and subsequently guided from the delivery system itself to a cutting apparatus where they are cut to format. The stabilization is effected only (if at all) by holding the printed products in the belts. The force effect for changing direction is absorbed only via the conveyor belts.

The following problems occur in the process:

Concerning the center offset: The horizontal position (center offset) of the printed products in the delivery system is not "defined," i.e., the printed products slip more or less far on the ejector as a result of their kinetic energy. Thus, the position in the delivery system may vary by +/−a few millimeters.

Concerning slant: The printed products still have kinetic energy in the transport direction at the time when the printed product passes into the conveyor belts of the delivery system. This leads to a tilting moment or torque of the printed product itself, wherein a moment is additionally and deliberately (but unintentionally) exerted on the printed product again by the second deflection in the delivery system.

Concerning the undefined transport phase: The product does not have a clearly defined position during the transfer.

DE102004011973 A1 discloses a saddle stitcher with at least one stapling station for stapling sheets, wherein the stapling station is arranged on a stapling slide movable in the longitudinal direction of a saddle chain during the stapling process, and wherein at least an ejector unit for ejecting the sheets is provided in the transport direction of the sheets behind the stapling station. Accordingly, this saddle stitcher is characterized in that at least one acceleration unit and/or braking unit for accelerating and/or braking the sheets in the longitudinal direction to the ejector unit is arranged between the stapling slide and the ejector unit. Accordingly, the ejector unit lifts the braked sheets from the saddle chain. In the chronological sequence of this saddle stitcher, the sheets are collected, stapled, in order to then preferably be gripped and lifted in the braked state—in particular, at standstill—by the ejector unit in order to, in turn, ensure that they can be lifted off. The invention seeks to remedy precisely that.

EP1593526 B1 discloses a saddle stitcher for brochures, comprising a stapling machine, a delivery station loaded with the brochures on a step-by-step basis during normal operation, a front cutting blade arrangement, defining a cutting plane, for cutting the brochures along a respective target cutting line, and having transport means components which transport the brochures from the delivery station to the front cutting blade arrangement during normal operation. Sensors are present which emit signals defining the phase positions of the stapling machine and of one of the transport means components. A control processing these signals, which control controls the one of the transport means components (brochures ejector; trimmer feed) in such a way that, at a predetermined phase angle of the stapling machine, the respective target cut line is located in the cutting plane, regardless of the width of the respective brochure. No adaptations of a cycle-precise "on-the-fly" are evident from this publication.

EP1153764 A2 discloses a saddle stitcher which has at least the assemblies stapling slide, saddle chain, stapling/lifting device, delivery system, and ejector. At least two of these assemblies each have a separate drive, and controllable motors are provided as a drive source. Each of these motors has a control unit which synchronizes the movement of one assembly to the movement of at least one other separately-driven assembly. It should also be noted here that no adaptations of a cycle-precise "on-the-fly" are evident.

SUMMARY

An embodiment of the present invention provides a system that includes: a transport chain, which is roof-shaped in an upper region, along which one or more printed products are astride transportable, collected, and are optionally stapled in an intermediate stapling station; and a stop adjustable according to a format of a printed product of the printed products, the stop being arranged in a transport direction of the printed product, behind the stapling station, and along a further course of the transport chain. The stop is in operative connection with a delivery system and an ejector that operate interdependently with each other to perform a format-stabilized discharge of the printed product in accordance with a cycle; and that the format-stabilized printed product is fed to a cutting apparatus.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
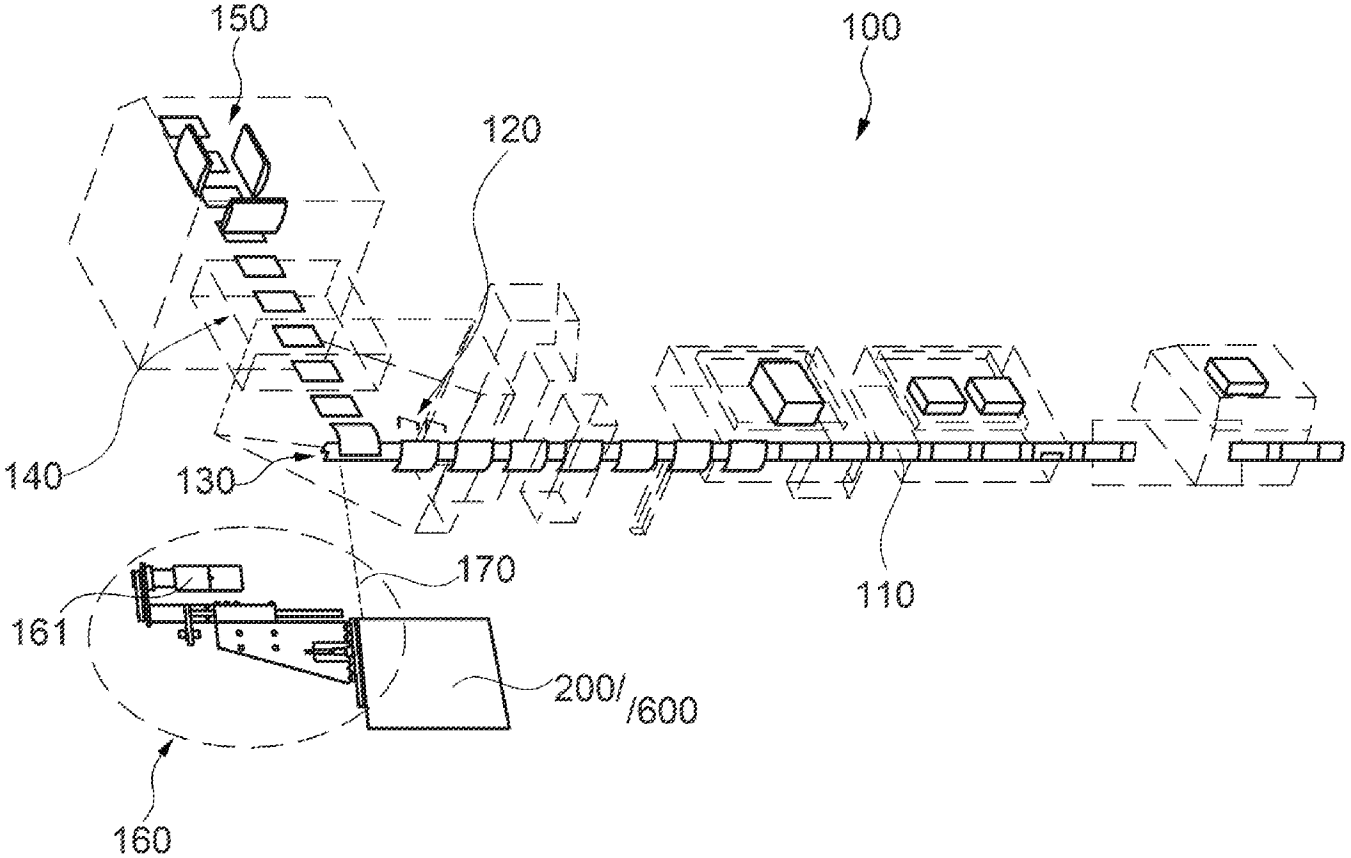
FIG. 1 illustrates an overall view of a saddle stitcher.

Embodiments of the present invention relate to a system, preferably designed as a saddle stitcher that essentially consists of a transport chain, which is designed to be roof-shaped in the upper region, along which one or more printed products, preferably designed as folded sheets, are astride transportable, collected, and preferably stapled as a brochure in an intermediate stapling station.

This type of transport can also be used for non-stapled, assembled printed products, wherein these products can also be present in the form of a set of folded sheets. These folded sheets are generally transported along the transport chain designed as a saddle chain to a stopping point, and these folded sheets are then conducted further from there via at least one feeding device to a cutting apparatus, in which the folded sheets, or the brochure assembled therefrom, are cut to format.

This invention represents a further step in the field of digitization. For example, one basis for this technical advance is the technical implementation, viz., that a production machine is now available, which can be operated down to a print run size=1. In order for such production machines to fulfill this requirement, the following prerequisites should be met:

There should be communications to higher-level control systems which provide the necessary data from the production process;

The production machines should be designed such that the necessary settings can be made on-the-fly (see list of definitions) for each production cycle.

Below are important terms that bear upon the application:

Folded sheet (sheet): A folded sheet, partial product of the printed sheet (paper printed on both sides) consisting of several sheet parts.

Brochure: Printed product consisting of at least one or more folded sheets.

Staple: Consisting of wire, which obtains this form in a first step ⊓ and which is pushed through the brochure and subsequently bent ⊂⊃ .

Stapling head: Cuts and positions the staple wire and forms the staple wire into a staple.

Stapling process: Process in which at least one staple is pushed through the brochure and closed at the other end.

Stapling slide: Part of the stapling station on which the stapling heads are mounted.

Stapling station: Staples a product by means of a staple while the stapling slide is synchronized with the transport chain.

Product: Consists of at least one folded sheet which is assembled into a brochure.

Thickness-variable: Receiving brochures and/or sheet parts of different thicknesses.

Cutting apparatus: Cutting system which has a front blade and two side blades and performs the cutting process consisting of a front cut and a head/foot cut as a subsequent cut.

Saddle stitcher: In a saddle stitcher, several sheets are typically collected on a transport chain, stapled in the stapling station, and cut on three sides in the cutting apparatus.

Saddle chain: The saddle chain has a guide device, the upper section of which is blade-shaped and the ridge line of which defines the transport and stapling line, and an essentially roof-shaped support, astride which the sheet parts are transported.

Delivery system: Machine component that transports the products after the stapling station into the feed to the cutting apparatus. In the delivery system, the transport direction changes by 90° to the front or to the rear, depending upon the position of the cutting apparatus.

Product feed: Conveyor belt which transfers products after the delivery system into the cutting apparatus. The conveyor belt has mechanical stops which move synchronously with the cutting apparatus.

Ejection phase, eject: By means of a device, called an ejector, the product is lifted from the saddle chain until it is picked up by the conveyor belts in the delivery system and transported further in the delivery system.

On-the-fly: Changes, e.g., of settings, positions of devices, etc., possible during operation.

MIS: In conjunction with the term, "Industry 4.0," terms such as "Finishing 4.0," "Print 4.0," or "Web to Print" are known in the printing industry. This basically refers to the digital transformation of the IT sector and production technology. In order to achieve these aims, Management Information Systems are required.

Embodiments of the present invention remedy certain deficiencies of the state of the art. For example, embodiments of the present invention can provide an improvement of over the state of the art due to meeting the following criteria:

Positioning: The printed products are clearly defined in a horizontal position with respect to the transport direction (saddle chain).

Stopping the printed product: If there is possibly still existing kinetic energy (remanence speed) in the transport direction, it is completely eliminated in the immediate region of a stop.

Stabilizing: The printed product is stabilized during the ejection phase into the delivery system, i.e., a possible twisting and/or tilting moment is thus absorbed or suppressed.

All underlying criteria of the aim extend to the entire operative speed range of the system, to all format sizes and thicknesses of the printed products, and to the behavior of the respective paper material of which the individual folded sheets consist.

Certain improvements of the present invention are achieved by operating with an automatically adjustable stop. This stop is correspondingly positioned with an electric motor (typically a servomotor), horizontal and preferably parallel to the transport direction. This position is defined by the control profiles implemented in the main controller, wherein such a position can also be correspondingly changed for each advanced, differently-designed, printed product. Such a positioning of the stop is dependent upon important parameters which are transmitted continuously to the main control, viz., at least the following:

Format size of the folded sheets;

Machine speed;

Possible manually-entered offsets.

Furthermore, sensors are preferably installed in the immediate vicinity of the stop, or integrated therein, which sensors are able to detect a paper jam immediately, and to trigger corresponding relief measures which also serve for machine protection. For this purpose, jam switches, camera systems, photocells, etc., are preferably installed. In addition, sensors, preferably in the form of photocells, camera systems, etc., are also provided which serve as feedback for the position control of the printed product.

An exemplary embodiment of the present invention is characterized as follows:

The folded sheets or the brochure formed therefrom (see list of definitions) lie on a saddle-shaped saddle chain (see list of definitions) and are transported toward the stop. Between the stapling machine and delivery system (see list of definitions), before reaching the stop, the carriers integrated into the saddle chain, which carriers act on the trailing edge of the folded sheets and ensure the targeted transport of the folded sheets in operative connection with the saddle chain, fold rearwards so that they can then slide further under the folded sheet through the continued travel of the saddle chain.

As a result, during its final transport phase, the printed product thus formed is no longer guided along by the carrier, but can be transported further to the stop solely by the friction induced by the saddle-shaped saddle chain or the remaining force. It is also important in this case that the printed product open in a spread-apart manner as a result of the triggered kinematics in this final phase, i.e., between the stapling machine and the delivery system, so that the folded carrier can easily move through under the same—especially in those cases in which the printed product should experience a delay during the delivery operation.

In this case, the stop according to the invention has a multiple function with respect to the final positioning of the folded sheet or the brochure, viz., that the function applies a certain nominal fixed stop position with respect to the transported printed product as a final location, but not exclusively in a conventional manner as a fixed stop station. That is, the printed product is not transported in the horizontal transport movement to the fixed wall of the stop in order to then be completely braked there, but instead this stop simultaneously performs the function of serving as an alignment aid for the front edge of the printed product against a twisting or tilting thereof during the further dynamic transfer into the delivery system. As a result of its special design and in operative connection with the controlled transport of the printed product, the stop thus fulfills a double function, which is characterized in the immediate region of the stop by horizontally/vertically superimposed movements of this printed product.

These superimposed movements are to be understood as follows: On the one hand, there is a horizontal movement of the printed product (folded sheet or brochure) predetermined by the saddle chain, the kinematic energy of which printed product is now not completely and abruptly eliminated by the stop, but instead the printed product is picked up and lifted away from the saddle chain by the locally-acting means of the delivery system and of an ejector in operative connection therewith shortly before impinging on the stop.

During this time interval, tending towards zero, the printed product further conveyed in the horizontal direction still has a minimized remanence speed in the horizontal direction, which causes a full, close abutment and subsequent sliding of the front edge of the ejected printed product along the wall of the stop. This assumed and also dynamically adjustable positioning of the stop is therefore also dependent upon the speed with respect to the respective advanced printed product.

This sliding along of the front edge of a folded sheet or of the brochure during the operative transfer of the printed product caused by the dynamics of the delivery system ensures that a twisting of the same, which cannot be ruled out, does not happen, so that the printed product has a perfect alignment with respect to the format during the subsequent cutting.

Thus, in the final phase of the positioning of the printed product, there is a matched, control-guided interdependence between the horizontal movement of this printed product and its vertical transfer, wherein the stop performs a double function, as already explained, viz., on the one hand, ensuring the final position of the advanced printed product and, on the other, preventing possible twisting of the printed product during the vertical movement. The stop thus absorbs counter movements, which could lead to a tilting moment acting on the printed product, as a result of which the printed product could slant. These processes are in operative connection with a blade as part of an ejector arranged on the underside of the saddle chain, which part is discussed in greater detail below.

The sequence of a cycle is thus designed as follows:

When the job is set up, the stop is moved to the correct position, depending upon various parameters such as format size, speed, etc.

Such a positioning of the stop can also be done continuously during the discharge.

During operation, the stop is monitored with sensors (such as photocells, camera systems, etc.) and readjusted, if necessary, "on-the-fly" (see list of definitions) via the control.

The position-based setting of the stop and the continuous monitoring of the process are preferably carried out by stored control profiles, wherein the main controller can carry out a regulation according to adaptive principles. Furthermore, the main controller can also provide a predictive/anticipatory control.

The advantages of the invention relating to the stop, which also form an integral part of the subject matter of embodiments of the invention, is essentially described as follows:

a) Particularly through the separate drive (servomotor) of the stop, the perfect setting (see list of definitions) is established for each printed product by the "on-the-fly" operation.

b) The assumed operative position of the stop is essentially dependent upon the format of the advanced folded sheet or brochure and on the speed of the saddle chain. This assumed operative position of the stop is established, as mentioned above, in a controlled manner, according to stored control profiles, or continuously, in a regulated manner.

c) From continuous feedback from sensors, such as photocells, camera systems, etc., the position of the stop is additionally continuously adjusted in "on-the-fly" operation.

d) The stop absorbs counter movements of the printed product, which could lead to a tilting moment thereof, thus ensuring that the folded sheet, the brochure, or the printed product can generally assume a maximized format-dependent and targeted position during the discharge carried out by the delivery system.

e) The stop basically defines the final horizontal position of the product with respect to the discharge (also called ejection) initiated by the delivery system, wherein this position is always strictly oriented towards the fact that the discharge always ensures a central ejection with respect to the operating means of the delivery system—in this case, preferably formed by conveyor belts—irrespective of the format size (minimum/maximum format) of the folded sheet.

f) The stop is, directly or indirectly, additionally equipped with corresponding sensors, which aim to control congestion, can detect a congestion early, and can also counteract it by interposed, regulating interventions, whereby damage to the system can be prevented or the time for corrective maintenance can be sustainably reduced.

In order to complete the discharge of the folded sheet/brochure described so far, the kinematics of a blade in operative connection with the saddle chain take on an eminent, important role. The following phases are of importance:

Phase I: First, the preferably directly or indirectly motor-driven blade remains below the delivery system in a neutral position ("zero position"). Here, the blade, as part of the ejector, waits for the arrival of the command, "trigger," for triggering the movement kinematics. The ejector then starts its movement at the "trigger" position in order to push the printed product into the delivery system as consistently as possible. This triggering point depends upon the product format, upon the speed of the saddle chain, and upon a possible manual correction insofar as a defined or continuously freely-definable speed threshold is exceeded or undershot, which determines whether the subsequent phases II. or III. are initiated.

Phase II: Above the speed threshold, the speed of the ejector is oriented towards that of the saddle chain, or of the conveyor belts of the delivery system belonging to the delivery system. That is, when the speed of the saddle chain is increased, the ejector (the blade) moves upwards correspondingly faster. When the speed of the saddle chain is reduced, the ejector moves correspondingly slower.

Phase III: The movement profile is constant below the speed threshold. A minimum speed of the ejector is thus defined, in order to ensure the transfer of the printed product to the conveyor belts of the delivery system.

As regards the path movements of the ejector, the following positionings must be distinguished:

a) On the one hand, the ejector moves to a point called "top position." This "top position" is the upper turning point of the blade; from there, the position, "bottom position," is approached with a defined or continuously freely-definable speed.

b) "Bottom position" is the lower turning point of the blade; from there, the position, "zero position," is approached with a defined or continuously freely-definable speed.

The blade as part of the ejector therefore assumes three fixed positions, which either are positions defined in advance or are continuously freely defined. That is, the "top position" is the highest position of the blade and forms as it were its turning point, where the transfer of the folded sheet to the conveyor belts of the delivery system is completed. The "bottom position" is the lowest position of the blade as a turning point; therefore, the blade moves downwards to this position in order to not collide with the following, advanced printed product on the saddle chain. The "zero position" represents that neutral position from which the blade starts to function for a next printed product.

Job data from an MIS (see list of definitions) or from a separate data system preferably lead to the activation of stored control profiles, which, in particular, include the format data of the individual folded sheets, those of the brochure, such as cut width and length, and other data which are required for the qualitative implementation of the job. Preferably, the main controller also contains algorithms which continuously calculate the thickness of the brochures from the production of the individual folded sheets.

Based upon these values, the main controller calculates the position of the blade and controls its movement, which takes place mechanically by means of an ejector tappet, whereby the operative position of this blade is always precisely defined.

The advantages of embodiments of the invention relating to the operating mode of blade and ejector, which also form an integral part of the subject matter of embodiments of the invention, is essentially described as follows:

A dynamic, variable ejection time is used;

The dynamically variable profile is continuously calculated by the main controller or entered by predetermined tables, wherein these values are supported by either stored control profiles or algorithms for dynamic control/regulation;

A regulation based upon optical measurements continuously intervenes, which directly leads to targeted corrections or predictive controls;

The ejection profile may also be designed to be changeable by "on-the-fly" dynamics;

The control/regulation of the entire process across all units involved takes place continuously by determining thicknesses and format of the printed sheets (folded sheets) and by the continuously determined speeds of the transport chain (saddle chain);

As required, a freely-selectable profile can be implemented, which is operated completely independently of other parameters, such as saddle chain speed or delivery system conveyor belt speed;

Start/stop ramps are freely programmable, adaptable to the situation, and regulatable;

The units of the system involved allow for them to be reprogrammed to non-linear movement sequences.

As described above, embodiments of the invention relate to a system which is designed as a saddle stitcher. The system essentially consists of a transport chain, which functions as a saddle chain, which is roof-shaped in the upper region, and along which one or more printed products preferably formed as folded sheets are collected and transported astride. The transport chain preferably has an intermediately arranged stapling station, in which folded sheets which are generally placed on top of each other is stapled to form a brochure. In the transport direction of the folded sheets, behind the stapling station, a folded-sheet-related adjustable stop is arranged along the further transport chain and is in operative connection at least with means for discharging the folded sheets. These means consist at least of a delivery system and an ejector, which in turn are in operative connection with one another. As a result of the operative effect of these means, the folded sheets experience a direction change in relation to the transport direction of the transport chain of or about 90°, wherein these folded sheets, or the brochure formed therefrom, are, subsequently, preferably fed to a cutting apparatus.

The adjustable stop has a stop wall which is arranged on the front side with respect to the transport direction of the transport path functioning as a saddle chain, and which fulfills a stop and alignment function with respect to the front edge of the folded sheets, wherein the saddle chain is furthermore equipped with foldable transport fingers. These fingers fold in the final phase of the stopping process so that the saddle chain can pass through under the spread folded sheets.

The delivery system has a series of conveyor belts, which act in a coordinated manner and which, in operative connection with an ejector operating on the underside of the ridge of the folded sheets, bring about the discharge of the folded sheets. The ejector itself is equipped with a projecting blade which conveys the folded sheets into the delivery system through a path extending vertically from below.

The interdependent operation of the transport chain, stop, delivery system, ejector, and cutting apparatus is guided by a main controller, wherein this operation relates to at least the aforementioned units of the system, which are operated by stored control profiles and/or by an adaptive and/or predictive control.

The operative connection between the stop and the means of the delivery system is carried out according to the following criteria:

i) By means of a separate drive, the stop is adjusted individually in the transport direction for each folded sheet format in relation to its final position;

ii) The assumed final position of the stop is substantially dependent upon the speed of the transport chain and the format of the advanced folded sheet;

iii) The stop defines the final horizontal position of the folded sheet with respect to the discharge initiated by the operative means of the delivery system, wherein this final position is then adjusted such that the folded sheet is aligned independently of the respective format size centrally to the operative means of the delivery system;

iv) The final operative position of the stop to be assumed is controlled by stored control profiles or is continuously regulated by sensors, such as photocells, camera systems;

v) The one surface of the stop on the side of the folded sheet has a stabilizing effect against a tilting moment and/or slant of the folded sheet during the discharge of the same carried out by the operative means of the delivery system and of the ejector, wherein the operative means of the delivery system consist of conveyor belts, which pick up the folded sheets on the side of the fold for further transport.

The stop itself is directly or indirectly equipped with corresponding sensors which respond to a congestion monitoring in the flow of the folded sheets, and such information is then forwarded to the main controller. The operative connection between the stop and the means of the delivery system for discharging the printed product is generally carried out according to the following criteria:

i) A blade, as part of a tappet, arranged below the delivery system and preferably equipped with a separate drive, of the ejector remains in a neutral position ("zero position") until a command, which is transmitted by the main controller and initiates the "trigger" for discharging the printed product, is received;

ii) The ejector starts its movement from this "trigger" position in order to consistently transfer the printed product into the delivery system, wherein this trigger depends, time-wise, upon the speed of the transport chain, the format of the respective folding sheet, and a possible manual correction, and wherein the speed of the transport chain has a defined or continuously freely-definable speed threshold;

iii) Above the speed threshold, the speed of the ejector is oriented towards that of the transport chain and/or that of the conveyor belts belonging to the delivery system such that the vertical movement of the ejector upwards increases when the speed of the transport chain increases, and wherein the vertical movement of the ejector upwards decreases accordingly when the speed of the transport chain is reduced;

iv) Below the speed threshold, the movement profile of the ejector is uniformly defined by a minimum speed in order to ensure the transfer of the folded sheet to the conveyor belts of the delivery system.

With this kinematics, the blade belonging to the ejector moves up to an upper turning point (top position) during the discharge of the folded sheet. Furthermore, after completion of the discharge of the folded sheet, the blade moves down to a lower turning point (bottom position). Further, from the lower turning point (bottom position), the blade assumes a neutral position (zero position).

Exemplary embodiments of the present invention are described below with reference to the drawings.

FIG. 1 shows an overall view of a saddle stitcher 100. Essentially, such a saddle stitcher consists of a centrally-operating saddle chain 110 which takes over the transport of the folded sheets 200 or of the brochure 600. Such a saddle chain 110 has a guide device with an upper section which is designed to be pointed, i.e., roof-shaped, and whose ridge line defines the transport and stapling line, astride which the folded sheets 200 are transported. The individual folded sheets are assembled in a stapling machine 120 to form a brochure. The folded sheets rest on the saddle-shaped saddle chain and are transported therefrom towards the stop 160. Between the stapling machine 120 and a downstream delivery system 130, before reaching the stop 160, the carriers (not shown in more detail in the drawing) integrated into the saddle chain, which carriers act on the trailing edge of the folded sheets and ensure the targeted transport of the folded sheets in operative connection with the saddle chain, fold rearwards so that they can then slide under the folded sheet with the continued movement of the saddle chain. As a result, in the final transport phase, the printed sheets assembled into a brochure are no longer directly affected by the carrier, but are transported further to the stop solely by the friction induced by the saddle-shaped saddle chain, or the remaining force. Important in this case are also the triggered kinematics on the individual folded sheets or, in general, on the brochure in this final phase, viz., to the effect that the printed product opens between the stapling machine and the delivery system, so that the folded carrier can pass through underneath the printed product without problems; this also comes to bear especially in those cases in which this printed product should be delayed during the ejector operation.

The stapling machine itself, which is not shown in more detail and which belongs to the prior art, has a staple consisting of wire, wherein the wire is bent in a first step into a downwardly-acting U-shape, which is well suited to be pushed through the brochure and subsequently bent. This process is accomplished by at least one stapling head that cuts and positions the staple wire and forms it into a staple. Important in the stapling process itself is that at least one staple is pushed through the brochure and closed at the other end. Part of the stapling machine is also a stapling slide on which the stapling head is mounted, wherein the printed product is stapled within this stapling station by means of the staple already mentioned while the stapling slide moves.

The stop 160 with its predetermined stop plane 170 forms the final position of the transport on the saddle chain for folding sheets 200 or brochure 600 before said printed product is transferred to the delivery system 130 and is transferred from there via a product feed 140 into the cutting apparatus 150. This cutting apparatus 150 functions as a cutting system, which preferably has a front blade and two side blades and performs the cutting process consisting of a front cut and a head/foot cut as a subsequent cut.

The stop 160, preferably operated by a servomotor 161, fulfills multiple functions with respect to the final positioning of the brochure 600, viz., that this stop applies a fixed stop position with respect to the transported brochure in the very final state, but not exclusively in a conventional manner as a fixed stop station. That is, the brochure is not transported in the horizontal transport movement to the front wall of the stop in order to be completely braked there, as is the case according to the prior art, but, instead, this stop simultaneously performs the function of serving as an alignment aid for the front edge of the brochure in the transport direction against a twisting or tilting thereof during the further dynamic transfer of the brochure into the delivery system. As a result of its special design and in operative connection with the controlled transport of the brochure, the stop thus fulfills a double function, which is characterized in the region of the stop by superimposed horizontal/vertical movements of the brochure.

These superimposed movements are to be understood as follows: On the one hand, there is a horizontal movement of the brochure predetermined by the saddle chain, the kinematic energy of which brochure is now not completely and abruptly eliminated by the stop, but, instead, the brochure is ejected from the saddle chain by the ejector and picked up by the locally-acting means of the delivery system infinitesimally shortly before impinging on the stop.

During this time interval, tending toward zero, the brochure conveyed in the horizontal direction still has a minimized remanence speed, which causes a full, close abutment and subsequent sliding of the front edge of the brochure along the wall of the stop. This assumed and also dynamically adjustable positioning of the stop is therefore also dependent upon the speed with respect to the respectively advanced folded sheet.

This sliding movement of the front edge of the brochure along the wall of the stop in the vertical direction during the transfer of the brochure into the delivery system ensures that a twisting of the brochure, which cannot be ruled out, does not happen, so that the brochure has a perfect format alignment during the subsequent cutting.

Thus, in the final phase during the positioning of the brochure, there is a matched, control-guided interdependence between the horizontal transport movement of the brochure and its vertical transfer, wherein the stop performs the double function, as already explained, viz., on the one hand, ensuring the final position of the brochure and, on the other, preventing possible twisting during the vertical discharge of the same. Thus, the stop additionally absorbs those counter movements which could lead to a tilting moment of the brochure, whereby the brochure can no longer slant. These processes are in operative connection with a blade as part of an ejector arranged on the underside of the saddle chain, which is discussed in greater detail below.

Figure 2:
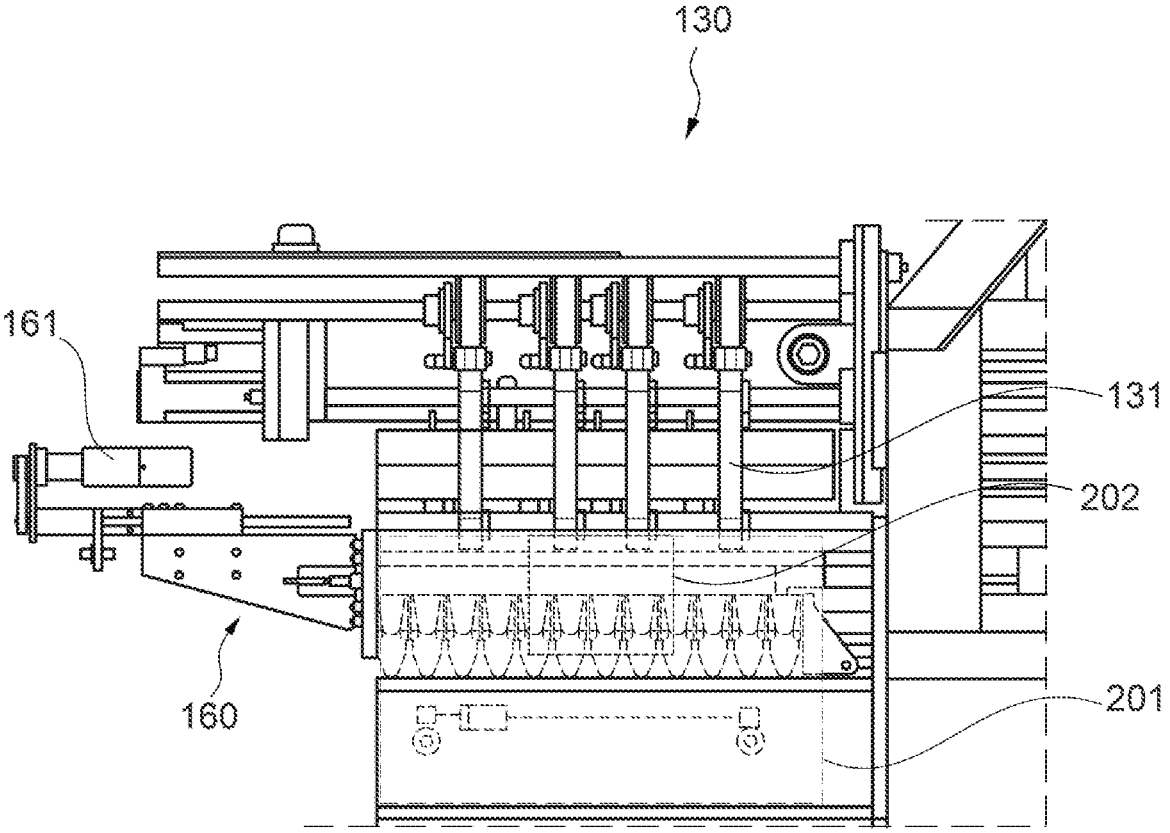
FIG. 2 illustrates an overall view of a delivery device with a driven stop.

FIG. 2 shows the delivery system 130 in operative connection with the already explained motor-driven 161 stop 160. This delivery system is formed as a machine component, which transports the folded sheet, the brochure, or, in general, the printed products after the stapling station into the product feed (see FIG. 1, pos. 140) to the cutting apparatus (see FIG. 1, pos. 150). In the delivery system itself, a transport direction changes of preferably 90° is carried out via the conveyor belts 131, depending upon the location of the cutting apparatus. The operating stop 160 basically defines the final horizontal position of the brochure with regard to the discharge implemented by the delivery system, wherein the delivery system is in operative connection with an ejector (see FIG. 4), wherein this position is always strictly oriented towards the fact that the discharge always ensures a central ejection with respect to the operating means of the delivery system, i.e., the conveyor belts 131 arranged next to each other, irrespective of the small format size 202 or the large format size 201 of the brochure.

Figure 3:
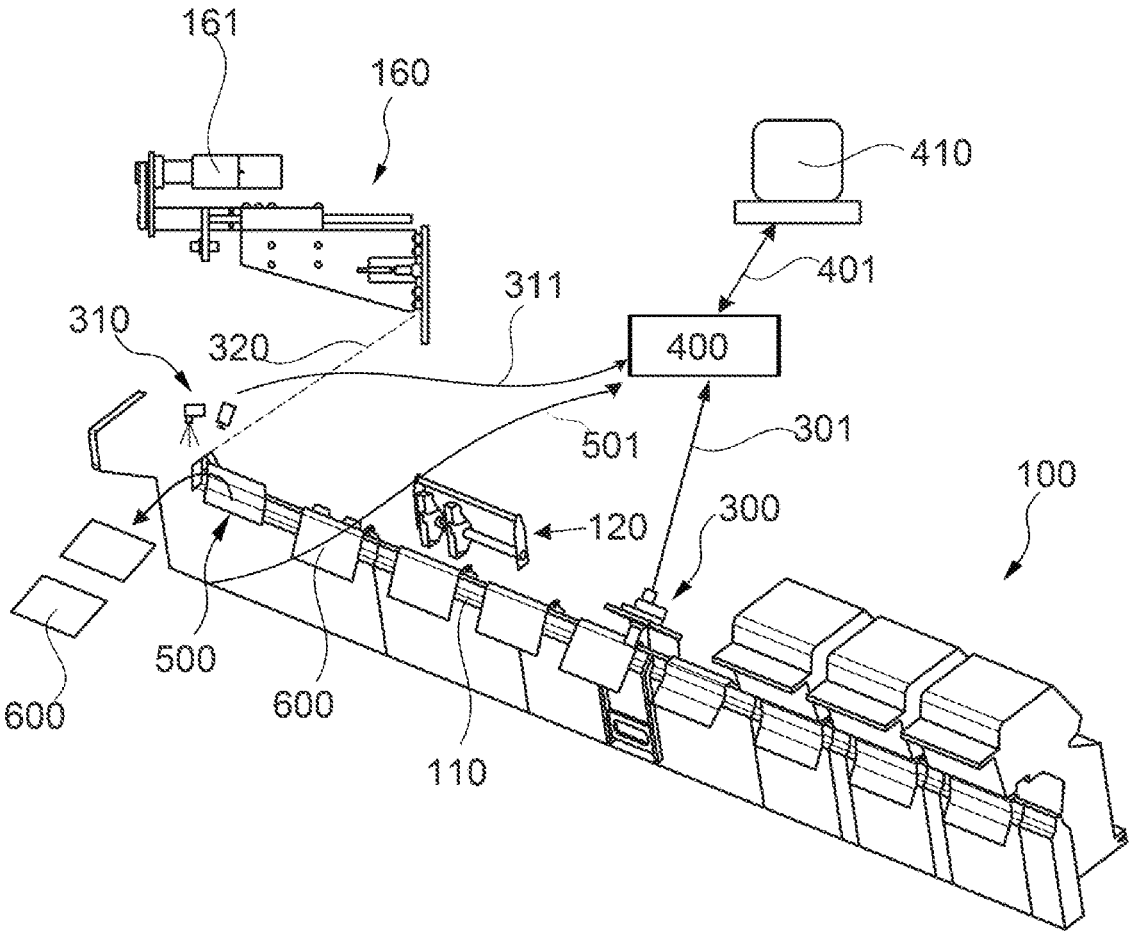
FIG. 3 illustrates an overall view of a saddle stitcher, with control/regulation functions.

FIG. 3 shows essentially the same saddle stitcher as in FIG. 1. This system is supplemented with essential control systems whose data are transmitted to a central control 400 which in turn communicates bidirectionally 401 with an MIS system 410. This control processes all incoming data from all units involved in the processing of the printed products, including the speed of the saddle chain 110, and then provides for the targeted regulation of all units, especially with regard to the operation of the transport chain, stop, delivery system, and ejector, depending upon the format size of the respective printed product. The flows shown here in the collection of the operational data for the control 400 are not to be understood as numerus clauses. First, an optical control system 310 in the region of the stop plane 320 of the stop 160 passes the obtained information 311 to the control 400. This is followed by continuously querying the ejector 500, whose information 501 is also forwarded to the control 400. Furthermore, the continuous thickness measurement 301 of the folded sheets is performed by device 300. Further collection of the operational data can take place for the stapling machine 120, for example. In addition, the control 400 is in operative connection in a bidirectional data flow system 401 with a management information system (MIS) 410, which system 410 has become known in the printing industry in connection with the term, "Industry 4.0," under the designations, "Finishing 4.0," "Print 4.0," or "Web to Print," for example. This basically refers to the digital transformation of the IT sector and production technology. In order to achieve these aims, MIS system 410 is used in particular.

From these collected data and the continuous monitoring of the process, the position-based setting and operating mode of the units participating in the process of the saddle stitcher are ensured. The integral control as such may be maintained by stored control profiles. The main controller is also capable of implementing a regulation according to adaptive principles; furthermore, the main controller is also capable of providing a predictive/anticipatory regulation.

Figure 4:
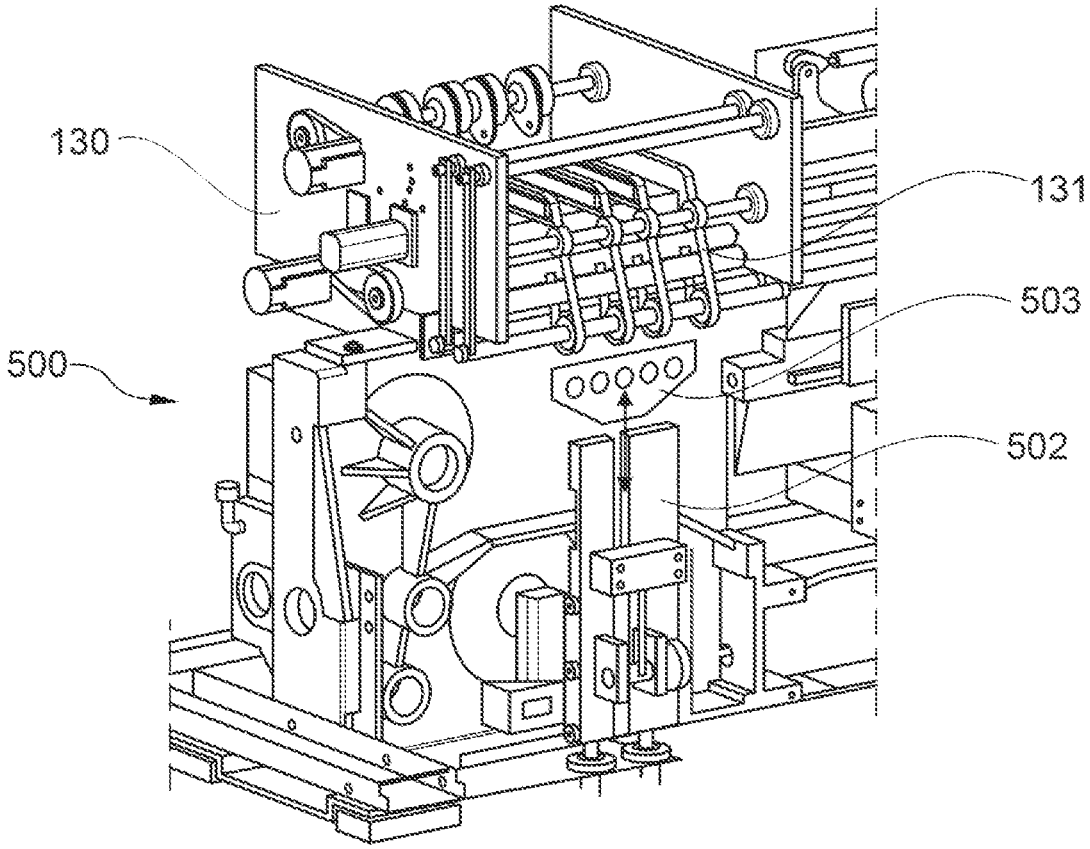
FIG. 4 illustrates an ejector in operative connection with a delivery system.

FIG. 4 shows an ejector device 500 which is in operative connection with the already described delivery system 130. The functionality of this ejector device or, generally, of this ejector 500 is as follows:

First, a blade 503 remains below the delivery system 130 in a neutral position ("zero position"). The blade 503, which is coupled to an ejector tappet 502 and forms the parts of the ejector in the front, waits there. The ejector tappet 502 preferably has a separate drive, and upon arrival of the command, "trigger," the triggering of the movement kinematics is started. When viewed as an overall unit, the ejector 500 then starts its movement at the trigger position, in order to transfer the printed product generally as consistently as possible into the delivery system. This "trigger" point is mainly dependent upon the speed of the saddle chain, the product format, and a possible manual correction, such that the subsequent phases are initiated as a function of whether a defined or continuously freely-definable speed threshold is exceeded or undershot.

Above the speed threshold, the speed of the operative parts 502, 503 of the ejector 500 is oriented towards that of the saddle chain, or of the conveyor belts belonging to the delivery system. That is, when the speed of the saddle chain is increased, the ejector moves upwards correspondingly faster. When the speed of the saddle chain is reduced, the ejector moves correspondingly slower.

The movement profile is constant, below the speed threshold. A minimum speed of the ejector is thus defined in order to ensure the transfer of the folded sheet to the conveyor belts of the delivery system in any case.

As regards the path movements of the ejector, the following positionings must be distinguished:

On the one hand, the ejector moves to a point called "top position." This "top position" is the upper turning point of the blade 503; from there, the position, "bottom position," is approached with a defined or continuously freely-definable speed.

"Bottom position" is the lower turning point of the blade; from there, the position, "zero position," is approached with a defined or continuously freely-definable speed.

The blade 503, or its tappet 502, of the ejector 500 therefore assumes three fixed positions, which either are positions defined in advance or are continuously freely defined. That is, the "top position" is the highest position of the blade and forms as it were its turning point, where the transfer of the folded sheet to the conveyor belts of the delivery system is completed. The "bottom position" is the lowest position of the blade as a turning point; therefore, the blade moves downwards to this position in order to not collide with the following, advanced folded sheet on the saddle chain. The "zero position" represents that neutral position from which the blade starts to function for a next folded sheet.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A system, the system comprising:

a transport chain, which is roof-shaped in an upper region, along which one or more printed products are astride transportable, collected, and are optionally stapled in an intermediate stapling station; and a stop adjustable according to a format of a printed product of the printed products, the stop being arranged in a transport direction of the printed product, behind the stapling station, and along a further course of the transport chain, wherein the stop is in operative connection with a delivery system and an ejector, the system being configured to controllably operate interdependently the stop, the delivery system, and the ejector to perform a format-stabilized discharge of the printed product in accordance with a cycle by situating the stop by at least one of horizontally or vertically superimposed movements compared to the printed product, the superimposed movements being configured such that a kinematic energy of the printed product in a horizontal movement is not completely and abruptly eliminated by the stop, and by operating the delivery system and the ejector, before the printed product is impinging on the stop, to pick up and lift away the printed product from the transport chain.

2. The system according to claim 1, wherein the delivery system is configured to discharge the printed product, which comprises one or more folded sheets, in accordance with the cycle.

3. The system according to claim 1, wherein the ejector is configured to discharge the printed product, which comprises one or more folded sheets, in accordance with the cycle.

4. The system according to claim 1, wherein the format-stabilized discharge of the printed product comprises a direction change with respect to the transport direction of the transport chain of or about 90° takes place during the discharge of the printed product.

5. The system according to claim 1, wherein the stop has a stop plane oriented towards the transport direction of the transport path, the stop plane configured to perform a matched stop and alignment function with respect to a front edge of the printed product, which comprises one or more folded sheets, during the performance of the format-stabilized discharge of the printed product.

6. The system according to claim 1, wherein the transport chain is a saddle chain that is equipped with foldable transport fingers for conveying the printed product, which comprises one or more folded sheets.

7. The system according to claim 1, wherein the delivery system comprises a series of conveyor belts, which are configured to act in a coordinated manner, which are in operative connection with the ejector arranged on an underside of a ridge of the printed product, and which are configured to contribute to the discharge of the printed product.

8. The system according to claim 7, wherein the ejector is equipped with a protruding blade, by which the printed product is conveyable from below into the delivery system.

9. The system according to claim 1, wherein the system is a saddle stitcher.

10. A method for operating a system, the system comprising a transport chain, which is roof-shaped in an upper region, along which one or more printed products are astride transportable, collected, and are optionally stapled in an intermediate stapling station; and a stop adjustable according to a format of a printed product of the printed products, the stop being arranged in a transport direction of the printed product, behind the stapling station, and along a further course of the transport chain, wherein the stop is in operative connection with a delivery system and an ejector that operate interdependently with each other to perform a format-stabilized discharge of the printed product in accordance with a cycle; the method comprising:

interdependently operating at least the transport chain, the stop, the delivery system, the ejector, and the cutting apparatus by a main controller, the interdependently operating comprising:

situating the stop by at least one of horizontally or vertically superimposed movements compared to the printed product, the superimposed movements being configured such that a kinematic energy of the printed product in a horizontal movement is not completely and abruptly eliminated by the stop, and operating the delivery system and the ejector, before the printed product is impinging on the stop, to pick up and lift away the printed product from the transport chain.

11. The method according to claim 10, wherein the interdependent operation is according to stored control profiles or by an adaptive or predictive control.

12. The method according to claim 10, wherein the main controller is in operative connection with at least one management information system.

13. A system, the system comprising:

a transport chain, which is roof-shaped in an upper region, along which one or more printed products are astride transportable, collected, and are optionally stapled in an intermediate stapling station; and a stop adjustable according to a format of a printed product of the printed products, the stop being arranged in a transport direction of the printed product, behind the stapling station, and along a further course of the transport chain, wherein the stop is in operative connection with a delivery system and an ejector, the system being configured to controllably operate interdependently the stop, the delivery system, and the ejector to perform a format-stabilized discharge of the printed product in accordance with a cycle, wherein the system comprises a separate drive, wherein the system is configured to controllably operate interdependently the stop and the delivery system such that the operative connection between the stop and the delivery system is configured to be carried out according to the following criteria:

a) via the separate drive, the stop is controllably operated such that, for each of the printed products in relation to its final position, the stop is positionable positioned individually in the transport direction;

b) an assumed final position of the stop is configured at least dependent upon a format of an advanced printed product, of the printed products, and is configured to take into account a speed of the transport chain;

c) the stop is configured to define a final horizontal position of the printed product with respect to the discharge initiated by a conveyor of the delivery system, wherein the assumed final position of the stop is controllably adjustable such that the printed product assumes a central position with respect to the conveyor of the delivery system during the discharge, irrespective of the format size;

d) a final operative position of the stop to be assumed is controlled at least by stored control profiles or is continuously regulated based on information from sensors; and e) one printed-product-related front wall of the stop is configured to have a stabilizing effect against a tipping moment or a slant of the printed product during the discharge carried out by a conveyor of the delivery system.

14. The system according to claim 13, wherein the stop is coupled to the separate drive, the separate drive being configured to drive the stop such that it is positioned for each of the printed products through an "on-the-fly" operation.

15. The system according to claim 13, wherein the conveyor of the delivery system comprises conveyor belts, which are configured to initially pick up the printed product on a side of a fold and transport the printed product further in conformity with the format.

16. The system according to claim 13, wherein the stop is directly or indirectly equipped with corresponding sensors which are configured to respond to a congestion monitoring in a flow of the advanced printed products, and such information is forwarded to the main controller.

17. The method according to claim 10, the method comprising operating the ejector, by the main controller, by operative process sequences to discharge the printed product, wherein the operative process sequences of the ejector for discharging the printed product are carried out according to the following criteria:

a) a blade of the ejector, which is arranged below the delivery system, remains in a neutral position until a command, which is transmitted by the main controller and initiates a trigger for the discharge, is received;

b) the ejector starts a movement of its operative parts from the trigger position in order to transfer the printed product into the delivery system, wherein the trigger depends, time-wise, upon at least one of a speed of the transport chain, a format of the printed product, and a manual correction, and wherein the speed of the transport chain has a defined or a continuously freely-definable speed threshold;

c) above the speed threshold, the speed of the ejector is oriented towards that of the transport chain and/or that of conveyor belt belonging to the delivery system such that the vertical movement of the ejector upwards increases when the speed of the transport chain increases, and wherein the vertical movement of the ejector upwards decreases accordingly when the speed of the transport chain is reduced; and d) below the speed threshold, the movement profile of the ejector is uniformly defined by a minimum speed in order to ensure the transfer of the printed product to the conveyor belts of the delivery system.

18. The method according to claim 17, wherein the blade of the ejector moves up to an upper turning point during the discharge of the printed product.

19. The method according to claim 17, wherein the blade of the ejector moves down to a lower turning point after the completion of the discharge of the printed product.

20. The method according to claim 17, wherein the blade of the ejector moves from a lower turning point to the neutral position.

* * * * *